US008842131B2

(12) United States Patent
Chalouhi

(10) Patent No.: US 8,842,131 B2
(45) Date of Patent: Sep. 23, 2014

(54) SYSTEM AND METHOD FOR FRAMEWORK CLIPPING

(75) Inventor: Olivier Chalouhi, Redwood City, CA (US)

(73) Assignee: Fanhattan LLC, San Mateo, CA (US)

( * ) Notice: Subject to any disclaimer, the term of this patent is extended or adjusted under 35 U.S.C. 154(b) by 200 days.

(21) Appl. No.: 13/347,667

(22) Filed: Jan. 10, 2012

(65) Prior Publication Data

US 2013/0176331 A1 Jul. 11, 2013

(51) Int. Cl.
*G09G 5/00* (2006.01)

(52) U.S. Cl.
USPC ..... 345/622; 345/620; 345/621; 345/623; 345/624; 345/625; 345/626; 345/627; 345/628; 715/762; 715/763; 715/784; 715/786; 715/810

(58) Field of Classification Search
CPC ..... G06T 15/30; G06T 15/40; G06T 11/40; G06T 15/005; G06F 3/04805
USPC ..... 345/422, 620–624, 629; 715/762–763, 715/784, 786, 810
See application file for complete search history.

(56) References Cited

U.S. PATENT DOCUMENTS

| | | | | |
|---|---|---|---|---|
| 7,823,076 | B2 * | 10/2010 | Borovsky et al. | 715/764 |
| 8,006,192 | B1 * | 8/2011 | Reid et al. | 715/762 |
| 8,196,112 | B1 * | 6/2012 | Cansizlar | 717/126 |
| 2001/0026277 | A1 * | 10/2001 | Dorrell | 345/474 |
| 2005/0210410 | A1 * | 9/2005 | Ohwa et al. | 715/821 |
| 2008/0034292 | A1 * | 2/2008 | Brunner et al. | 715/700 |
| 2008/0270919 | A1 * | 10/2008 | Kulp et al. | 715/762 |
| 2009/0167785 | A1 * | 7/2009 | Wong | 345/629 |
| 2010/0050130 | A1 * | 2/2010 | Farn | 715/853 |
| 2010/0275136 | A1 * | 10/2010 | Gower | 715/757 |
| 2011/0285743 | A1 * | 11/2011 | Kilgard | 345/592 |
| 2012/0169768 | A1 * | 7/2012 | Roth et al. | 345/629 |
| 2012/0212488 | A1 * | 8/2012 | Yu et al. | 345/422 |

* cited by examiner

*Primary Examiner* — Xiao Wu
*Assistant Examiner* — Todd Buttram
(74) *Attorney, Agent, or Firm* — Schwegman Lundberg & Woessner, P.A.

(57) ABSTRACT

A method and system for framework clipping are disclosed. A user interface tree of widgets corresponding to widgets requiring clipping is traversed. For each encountered widget, layer allocation operations are performed which include selecting a current, previous, or next layer to which to allocate the widget and determining whether the selected layer can accommodate the widget, where a determination that the selected layer cannot accommodate the widget results in a bit from a stencil buffer being allocated to the selected layer. A value of the selected layer is incremented to account for the widget being allocated to the selected layer A stencil test mask is generated as a combination of value of the layers previous to a current layer. The stencil test mask is written to the stencil buffer, and the layer allocation operations are repeated for each remaining widget.

14 Claims, 17 Drawing Sheets

| Bit | 7 | 6 | 5 | 4 | 3 | 2 | 1 | 0 |
|---|---|---|---|---|---|---|---|---|
| Layer | 3 | | 2 | | | 1 | | |
| Current Value | 0 | | 0 | | | 1 | | |
| Reference | 0 | 0 | 0 | 0 | 0 | 0 | 0 | 1 |
| Write Mask | 0 | 0 | 0 | 0 | 0 | 1 | 1 | 1 |
| Stencil Test Mask | 0 | 0 | 0 | 0 | 0 | 0 | 0 | 0 |
| Draw Test Mask | 0 | 0 | 0 | 0 | 0 | 1 | 1 | 1 |

| Bit | 7 | 6 | 5 | 4 | 3 | 2 | 1 | 0 |
|---|---|---|---|---|---|---|---|---|
| Layer | 3 | | 2 | | | 1 | | |
| Current Value | 0 | | 1 | | | 1 | | |
| Reference | 0 | 0 | 0 | 0 | 1 | 0 | 0 | 1 |
| Write Mask | 0 | 0 | 1 | 1 | 1 | 0 | 0 | 0 |
| Stencil Test Mask | 0 | 0 | 0 | 0 | 0 | 1 | 1 | 1 |
| Draw Test Mask | 0 | 0 | 1 | 1 | 1 | 1 | 1 | 1 |

| Bit | 7 | 6 | 5 | 4 | 3 | 2 | 1 | 0 |
|---|---|---|---|---|---|---|---|---|
| Layer | 3 | | 2 | | | 1 | | |
| Current Value | 0 | | 2 | | | 1 | | |
| Reference | 0 | 0 | 0 | 1 | 0 | 0 | 0 | 1 |
| Write Mask | 0 | 0 | 1 | 1 | 1 | 0 | 0 | 0 |
| Stencil Test Mask | 0 | 0 | 0 | 0 | 0 | 1 | 1 | 1 |
| Draw Test Mask | 0 | 0 | 1 | 1 | 1 | 1 | 1 | 1 |

| Bit | 7 | 6 | 5 | 4 | 3 | 2 | 1 | 0 |
|---|---|---|---|---|---|---|---|---|
| Layer | - | - | - | - | - | - | - | - |

FIG. 12A

| Bit | 7 | 6 | 5 | 4 | 3 | 2 | 1 | 0 |
|---|---|---|---|---|---|---|---|---|
| Layer | - | - | - | - | - | - | - | 1 |

FIG. 12B

| Bit | 7 | 6 | 5 | 4 | 3 | 2 | 1 | 0 |
|---|---|---|---|---|---|---|---|---|
| Layer | - | - | - | - | - | - | 2 | 1 |

FIG. 12C

| Bit | 7 | 6 | 5 | 4 | 3 | 2 | 1 | 0 |
|---|---|---|---|---|---|---|---|---|
| Layer | - | - | - | - | - | 3 | 2 | 1 |

FIG. 12D

| Bit | 7 | 6 | 5 | 4 | 3 | 2 | 1 | 0 |
|---|---|---|---|---|---|---|---|---|
| Layer | - | - | - | - | 3 | 3 | 2 | 1 |

FIG. 12E

| Bit | 7 | 6 | 5 | 4 | 3 | 2 | 1 | 0 |
|---|---|---|---|---|---|---|---|---|
| Layer | - | - | - | 3 | 3 | 3 | 2 | 1 |

FIG. 12F

| Bit | 7 | 6 | 5 | 4 | 3 | 2 | 1 | 0 |
|---|---|---|---|---|---|---|---|---|
| Layer | - | - | 2 | 3 | 3 | 3 | 2 | 1 |

FIG. 12G

| Bit | 7 | 6 | 5 | 4 | 3 | 2 | 1 | 0 |
|---|---|---|---|---|---|---|---|---|
| Layer | - | 3 | 2 | 3 | 3 | 3 | 2 | 1 |

FIG. 12H

| Bit | 7 | 6 | 5 | 4 | 3 | 2 | 1 | 0 |
|---|---|---|---|---|---|---|---|---|
| Layer | - | 3 | 2 | 3 | 3 | 3 | 2 | 1 |
| Layer 1, 1 : 1 | - | - | - | - | - | - | - | 1 |
| Layer 2, 2 : 10 | - | - | 1 | - | - | - | 0 | - |
| Layer 3, 8 : 1000 | - | 1 | - | 0 | 0 | 0 | - | - |
| Reference | 0 | 1 | 1 | 0 | 0 | 0 | 0 | 1 |
| Write Mask | 0 | 1 | 0 | 1 | 1 | 1 | 0 | 0 |
| Stencil Test Mask | 0 | 0 | 1 | 0 | 0 | 0 | 1 | 1 |
| Draw Test Mask | 0 | 1 | 1 | 1 | 1 | 1 | 1 | 1 |

FIG. 13

SYSTEM AND METHOD FOR FRAMEWORK CLIPPING

TECHNICAL FIELD

Example embodiments of the present application generally relate to data rendering, and in particular but not by of limitation, to a system and method for framework clipping.

BACKGROUND

Widgets are elements of a graphical user interface (GUI) that display information arrangements changeable by the user, such as a window or a text box. In some cases, clipping is required to prevent widgets from rendering outside of a bounding box. Widgets which are completely outside of a clipping box may be marked as non-visible to avoid rendering them, but in some cases, some widgets may, from time to time, be partially visible, thereby requiring clipping.

Current clipping algorithms exist but may suffer from an inability to clip non-rectangular areas or from a difficulty in clipping complex clipping shapes.

BRIEF DESCRIPTION OF DRAWINGS

The embodiments disclosed in the present disclosure are illustrated by way of example, and not by way of limitation, in the figures of the accompanying drawings. Like reference numerals refer to corresponding parts throughout the drawings.

FIGS. 12A-H are tables of bits dynamically allocated to one or more layers according to a dynamic layer allocation algorithm, according to some embodiments.

FIG. 13 is a table of layer and mask values corresponding to the scene depicted in FIG. 11 involving clipping rectangles, according to some embodiments.

DETAILED DESCRIPTION

Although the disclosure has been described with reference to specific example embodiments, it will be evident that various modifications and changes may be made to these embodiments without departing from the broader spirit and scope of the disclosure. Accordingly, the specification and drawings are to be regarded in an illustrative rather than a restrictive sense.

In various embodiments, a system and method for framework clipping are disclosed. A user interface tree of widgets corresponding to widgets requiring clipping may be traversed. For each encountered widget, layer allocation operations are performed. The layer allocation operations include selecting a current, previous, or next layer to which to allocate the widget, determining whether the selected layer can accommodate the widget, where a determination that the selected layer cannot accommodate the widget results in a bit from a stencil buffer being allocated to the selected layer and a value of the selected layer being incremented to account for the widget being allocated to the selected layer, and where a determination that the selected layer can accommodate the widget results in the value of the selected layer being incremented to account for the widget being allocated to the selected layer. A stencil test mask may be generated as a combination of value of the layers previous to a current layer. The stencil test mask is written to the stencil buffer, and the layer allocation operations are repeated for each remaining widget.

Figure 1:
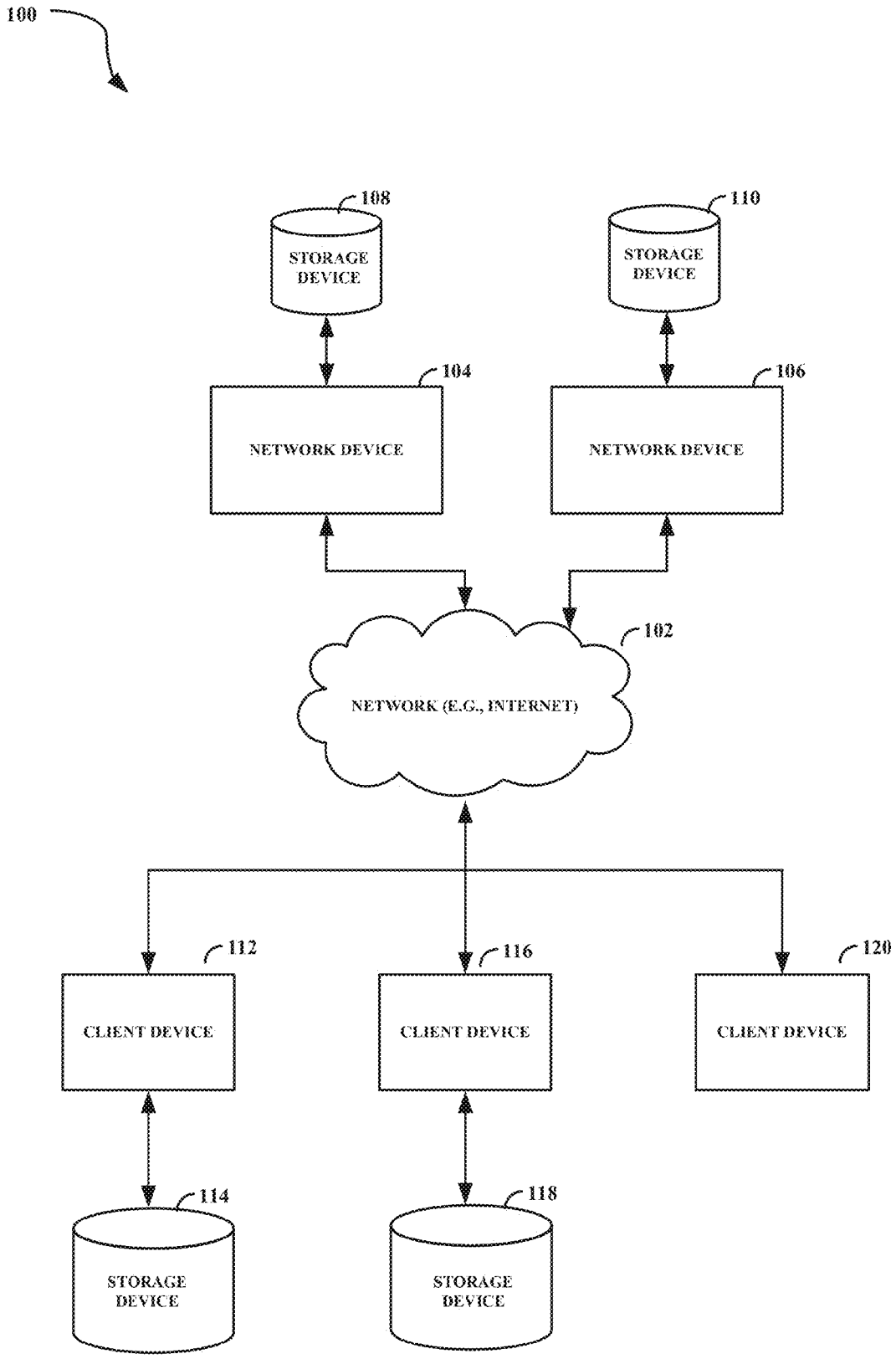
FIG. 1 is a block diagram illustrating a network system having an architecture configured for exchanging data over a network, according to some embodiments.

FIG. 1 is a block diagram illustrating an example network system 100 connecting one or more client devices 112, 116, and 120 to one or more network devices 104 and 106 via a network 102. The one or more client devices 112, 116, and 120 may include Internet- or network-enabled devices, such as consumer electronics devices (e.g., televisions, DVD players, Blu-Ray® players, set-top boxes, portable audio/video players, gaming consoles) and computing devices (e.g., personal computer, laptop, tablet computer, smart phone, mobile device). The type of client devices is not intended to be limiting, and the foregoing devices listed are merely examples. The client devices 112, 116, and 120 may have remote, attached, or internal storage devices 114, 118. For illustrative purposes only, although client devices 112 and 116 are shown in FIG. 1 as having connected storage devices 114 and 118, respectively, and client device 120 is shown without a connected storage device, in some embodiments, each client device 112, 116, and 120 may have local access to one or more storage or memory devices. One or more input devices may be used to interface with the client devices 112, 116, and 120. For example, a remote control may be used to interface with a client device. In some embodiments, the input devices each may have a touch-enabled interface that enables a user to use gestures to control the navigation and selection of content presented on the client device. Although the embodiments described herein reference a remote control device, it will be appreciated that other types of input devices (e.g., trackpad, mobile device, tablet computer, mouse, joystick) capable of supporting touch-based gestures and inputs may be used to interface with client devices.

In some embodiments, one or more of the client devices 112, 116, and 120 may have installed thereon and may execute a client application (not shown) that enables the client device to serve as a local media server instance. The client application may search for and discover media content (e.g., audio, video, images) stored on the device as well as media content stored on other networked client devices having the client application installed thereon. The client application may aggregate the discovered media content, such that a user may access local content stored on any client device having the client application installed thereon. In some embodiments, the aggregated discovered media content may be separated by device, such that a user is aware of the network devices connected to a particular device and the content stored on the connected network devices. In some embodiments, each connected network device may be represented in the application by an indicator, such as an icon, an image, or a graphic. When a connected network device is selected, the indicator may be illuminated or highlighted to indicate that that particular network device is being accessed.

In some embodiments, the discovered media content may be stored in an aggregated data file, which may be stored on the client device. The local content may be indexed by the client device in which the content resides. The client application also may aggregate and present a variety of remote sources to the user from which the user is able to download, stream, or otherwise access a particular media content item. For example, the client application may present to the user all streaming, rental, and purchase options for a particular media content item to the extent they exist and are available for access.

One or more network devices 104 and 106 may be communicatively connected to the client devices 112, 116, and 120 via network 102. In some embodiments, the network devices 104 and 106 may be servers storing media content or metadata relating to media content available to be accessed by the client devices 112, 116, and 120. In some embodiments, the network devices 104 and 106 may include proprietary servers related to the client application as well as third party servers hosting free or subscription-based content. Additional third-party servers may include servers operating as metadata repositories and servers hosting electronic commerce sites. For example, in the context of movies, third-party servers may be servers associated with the themoviedb.org and other third-party aggregators that store and deliver movie metadata in response to user requests. In some embodiments, some of the third-party servers may host websites offering merchandise related to a content item for sale. The network devices 104 and 106 may include attached storage devices or may interface with databases or other storage devices 108 and 110. For illustrative purposes only, the network devices 104 and 106 each have been shown as a single device in FIG. 1, although it is contemplated that the network devices 104 and 106 may include one or more web servers, application servers, database servers, and so forth, operating independently or in conjunction to store and deliver content via network 102.

In some embodiments where one or more of the network devices 104 and 106 are proprietary servers associated with the client application, the proprietary servers may store metadata related to media content and data that facilitates identification of media content across multiple content servers. For example, the proprietary servers may store identifiers for media content that are used to interface with third party servers that store or host the media content. The proprietary servers further may include one or more modules capable of verifying the identity of media content and providing access information concerning media content (e.g., the source(s) of media content, the format(s) of media content, the availability of media content).

The client application installed on one or more of the client devices 112, 116, and 120 may enable a user to search for media content or navigate among categories of media content. To find media content, a user may enter search terms in a user interface of the client application to retrieve search results, or the user may select among categories and subcategories of media content to identify a particular media content item. For each browsed content item, the client application may display metadata associated with the content item. The metadata may be retrieved from both local and remote sources. The metadata may include but are not limited to a title of the content item, one or more images (e.g., wallpapers, backgrounds, screenshots) or video clips related to the content item, a release date of the content item, a cast of the content item, one or more reviews of the content item, and release windows and release dates for various distribution channels for the browsed content item.

The client application may present one or more user interfaces for display by a client device to a user. One or more user interface elements (e.g., widgets) of the application may be rendered by the client device for display. In some embodiments, the client device may have a general purposes processor (e.g., CPU) and a specialized graphics processor (e.g., GPU). As part of the rendering of the user interfaces, the CPU and/or the GPU may perform clipping to render content within the boundaries of corresponding widgets.

Figure 2:
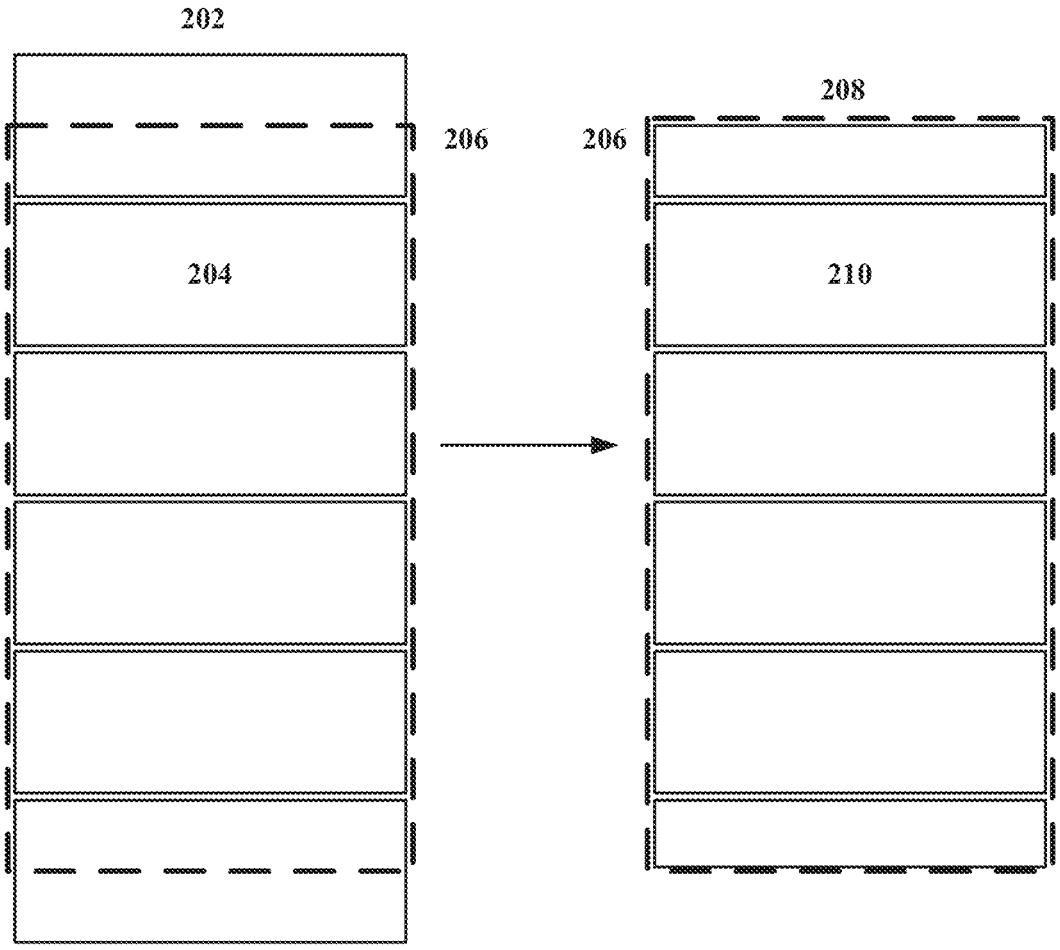
FIG. 2 is a diagram of a clipping operation performed on a vertical list of widgets, according to some embodiments.

FIG. 2 illustrates an example of a clipping process. A vertical list 202 may be presented in a user interface. The vertical list 202 may contain one or more widgets 204 and may be scrollable. Widgets within the boundaries 206 of the vertical list 202 may be displayed. When the list is scrolled, some widgets may be crossing the boundaries 206 of the list 202 and therefore require clipping. The widgets may be clipped, resulting in a clipped list 204.

Figure 3A:
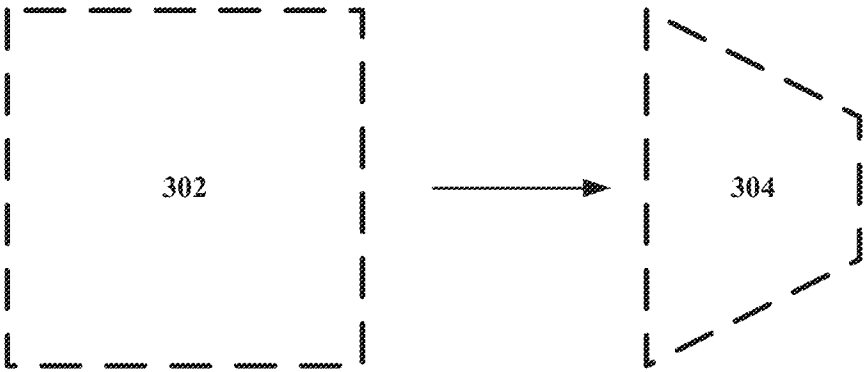
FIGS. 3A-B are a diagrams illustrating a rotation of a clipping rectangle and the intersection of multiple clipping rectangles, according to some embodiments.
Figure 3B:
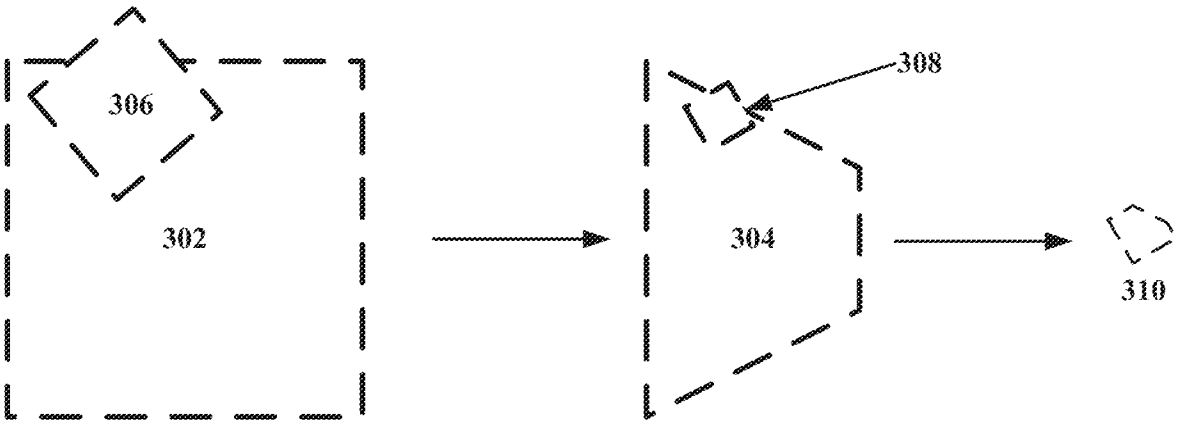

In some embodiments, there may multiple ways to implement clipping in OpenGL. One way to realize clipping is to use setScissors, which defines an on-screen rectangle where drawing is permitted. However, setScissors does not permit clipping of non-rectangular (on-screen) areas. In some embodiments, the widgets used by the client application may be rectangular, although the widgets may become non-rectangular on the screen as a result of transformations such as rotations. For example, referring to FIG. 3A, a rotation of a clipping rectangular 302 around the y-axis may result in a non-rectangular shape 304. Referring to FIG. 3B, a scenario is shown where multiple clipping rectangles are set within each other such that the rectangles intersect. Based on a rotation of the clipping rectangle 302 and the intersecting rectangle 306 about the y-axis, a non-rectangular shape 306 is obtained, along with a non-rectangular clipping shape 308. The resulting clipping area may be a complex clipping shape 310.

In some embodiments a stencil buffer may be used for clipping. The stencil buffer is an 8-bit buffer, with the same size as a frame buffer of the client device. In some embodiments, the stencil buffer may not be drawn directly to, but the contents of the stencil buffer may be changed by setting drawing states that result in the changing of the stencil buffer. For convenience here, this embodiment of setting drawing states to cause a change in the stencil buffer will be referred to herein as drawing to the stencil buffer.

A benefit of using OpenGL calls and the stencil buffer may be that the current transformation matrix may be leveraged.

Further, if the stencil buffer is used in a convenient way, previously set clipping areas may be used as a way to restrict child clipping areas further. By using OpenGL calls and the stencil buffer, clipping computations performed by a CPU may be avoided, and clipping may be performed solely by the GPU. Further, the GPU may clip to any shape, even before a transformation.

In some embodiments, the stencil buffer may set a custom write mask which protects the bits set to 0 in the mask from ever being modified. The stencil buffer also may set a custom test mask, which is applied to both the reference value and the current value before the two are compared. The stencil buffer also may compare the current value (for every given pixel) to a reference value and based on the result, either allow or not all drawing to a particular pixel. The stencil buffer may set values within the stencil buffer when a pixel is drawn to reflect certain operations performed. For example, the value may be unmodified, replaced with a reference value, incremented, or decremented, among other things.

In some embodiments, it may be impossible to test if the value in the stencil buffer is currently X and to replace the X value with Y for pixels that are drawn. This is because the same reference value has to be used for testing and writing to the stencil buffer. However, by using the write and test masks, the stencil buffer values may be tested to determine if they are currently X and if so, a Y value may be set in the stencil buffer assuming that X is a binary subset of Y (i.e., Y−X=Y XOR X).

Figure 4:
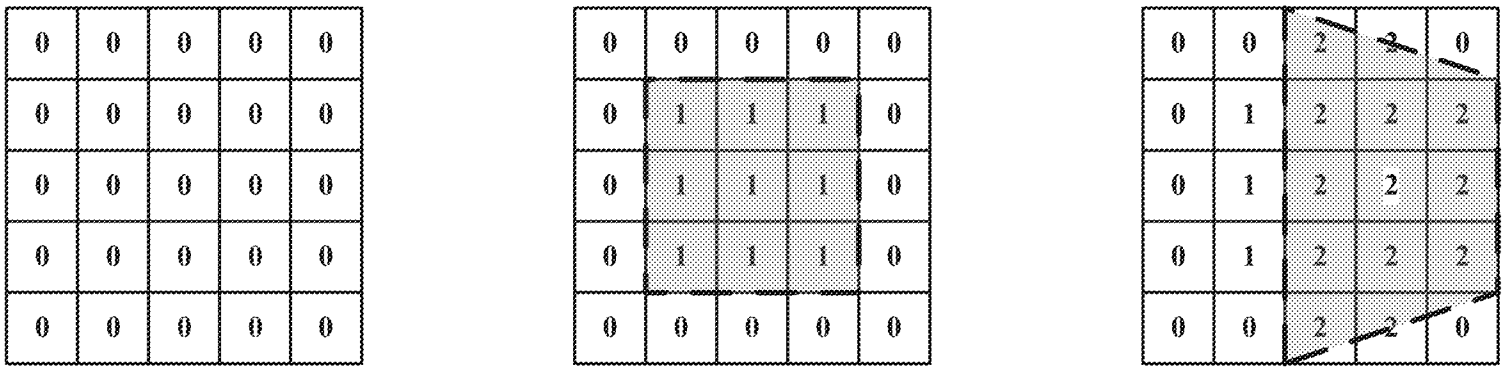
FIG. 4 is a diagram of a transformation matrix illustrating clipping rectangles, according to some embodiments.

In some embodiments, one way of using the stencil buffer is to clear it to 0, and then draw clipping shapes with a value which is incremented every time there is a new clipping area, as shown in FIG. 4. Then drawing is only allowed when the stencil buffer value matches the current value. This approach may not work with a clipping tree, and forces the application to perform the calculation and transformations of the clipping areas in software. It may be a valid approach for sibling clipping widgets.

Figure 5A:
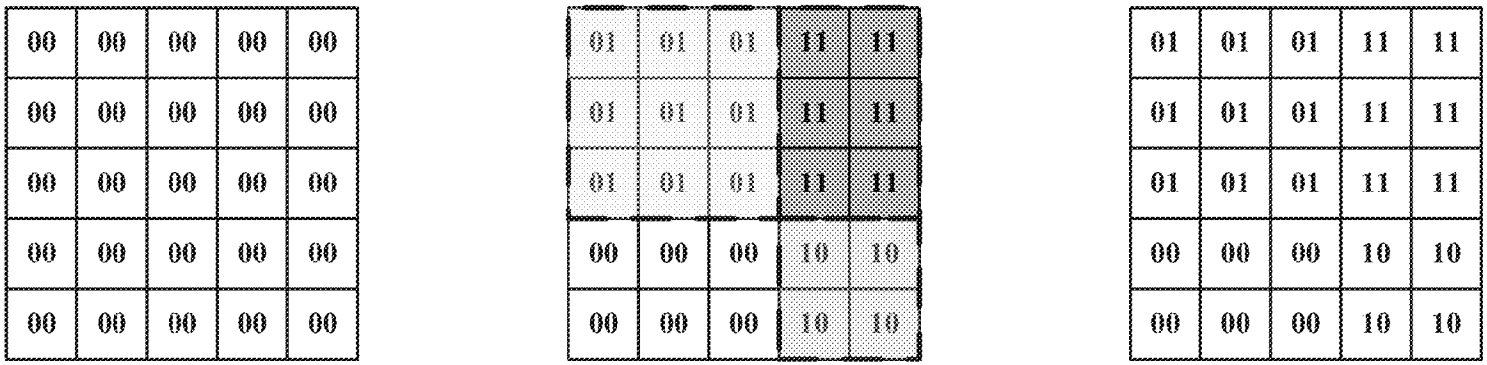
FIGS. 5A-B are diagrams of a transformation matrices illustrating clipping rectangles, according to some embodiments.
Figure 5B:
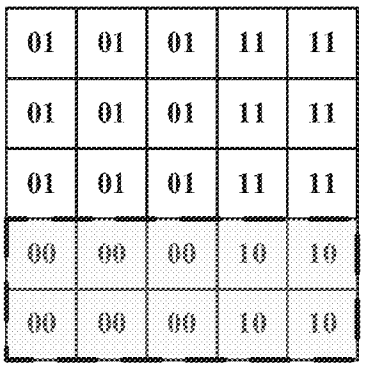

Another way to use the stencil buffer is to use the 8 bits of the stencil buffer as 8 different planes or masks and to then use the intersection of these masks (via a logical OR operation on their respective bit) as a test for drawing. One drawback with this approach is that it is not trivial to transform individual clipping widgets and containers into a set of 8 masks where some combination of masks would correspond exactly to the clipping areas. This approach would require reverse processing to occur on the CPU, and as rendering currently happens as a UI tree is being traversed, this approach would also result in a two-pass rendering and traversal. The approach could be used for parent-child clipping widgets as the parent could use one mask and the child another mask. For example, the embodiment of FIG. 5A shows two bits (i.e., two layers) used to represent a parent and a child widget. Clipping may occur on either of the four rectangles (e.g., 00, 01, 10, 11) by matching the value or on any of the four larger rectangles (e.g., *0, *1, 0*, 1*) by matching the value with a specific mask. Referring to FIG. 5B, such a mask, representing the lower bottom rectangle *0, is shown. In this case, a check may be performed for the value 00 with a test mask of 01 (i.e., because only the first bit needs to be checked). The upper rectangle will not match because all cells are *1, but the lower shaded rectangle will match.

Figure 6:
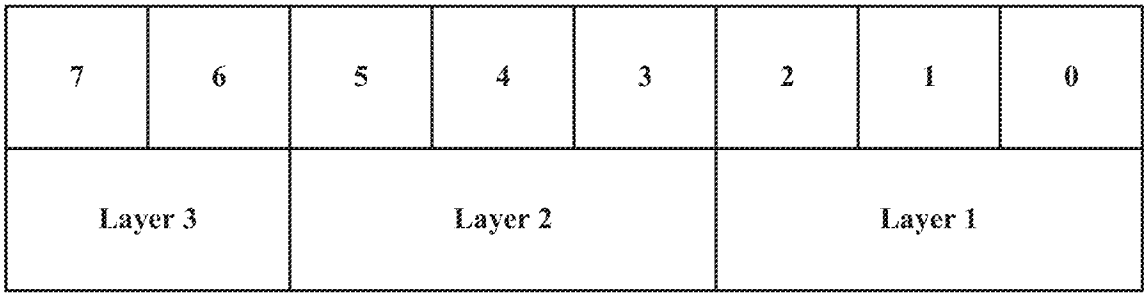
FIG. 6 is a diagram illustrating an allocation of bits of a stencil buffer to one or more layers that support clipping rectangles, according to some embodiments.

In some embodiments, a hybrid approach that leverages both methods discussed above may be employed. The eight bits of the stencil buffer may be split into multiple masks, and within each mask, an increment counter approach may be used. For example, FIG. 6 illustrates an embodiment in which three masks (or layers) are used, of 3, 3, and 2 bits each respectively. The stencil buffer may be initially cleared to 0. Clipping may start at a first parent layer of 3 bits with a value of 1. If clipping occurs among children widgets of clipping parent widgets, another layer is used. If clipping is needed within this layer, layer 2 is used for children widgets of the parent widget, and if clipping is needed in layer 2, then layer 3 is employed to account for another layer of children widgets. As clipping sibling widgets are encountered, the value of the current layer representing the children widget and sibling widgets is incremented. Drawing to a layer is restricted by having a matching value for all layers "above" to their current value. Drawing to the stencil buffer itself is restricted with the same condition, and in addition, only the current layer's bits are set as writeable. Setting a clip rectangle results in drawing the rectangle with no output to the screen, but letting the stencil buffer change (by replacing its value with the reference value and also using the write mask to protect the bits of the other layers) causes only drawing in the current clipping area by using the clipping values of upper layers (e.g., stencil test mask). Any subsequent drawing happens with a test on the stencil buffer on all active layers (e.g., draw test mask).

Figure 7:
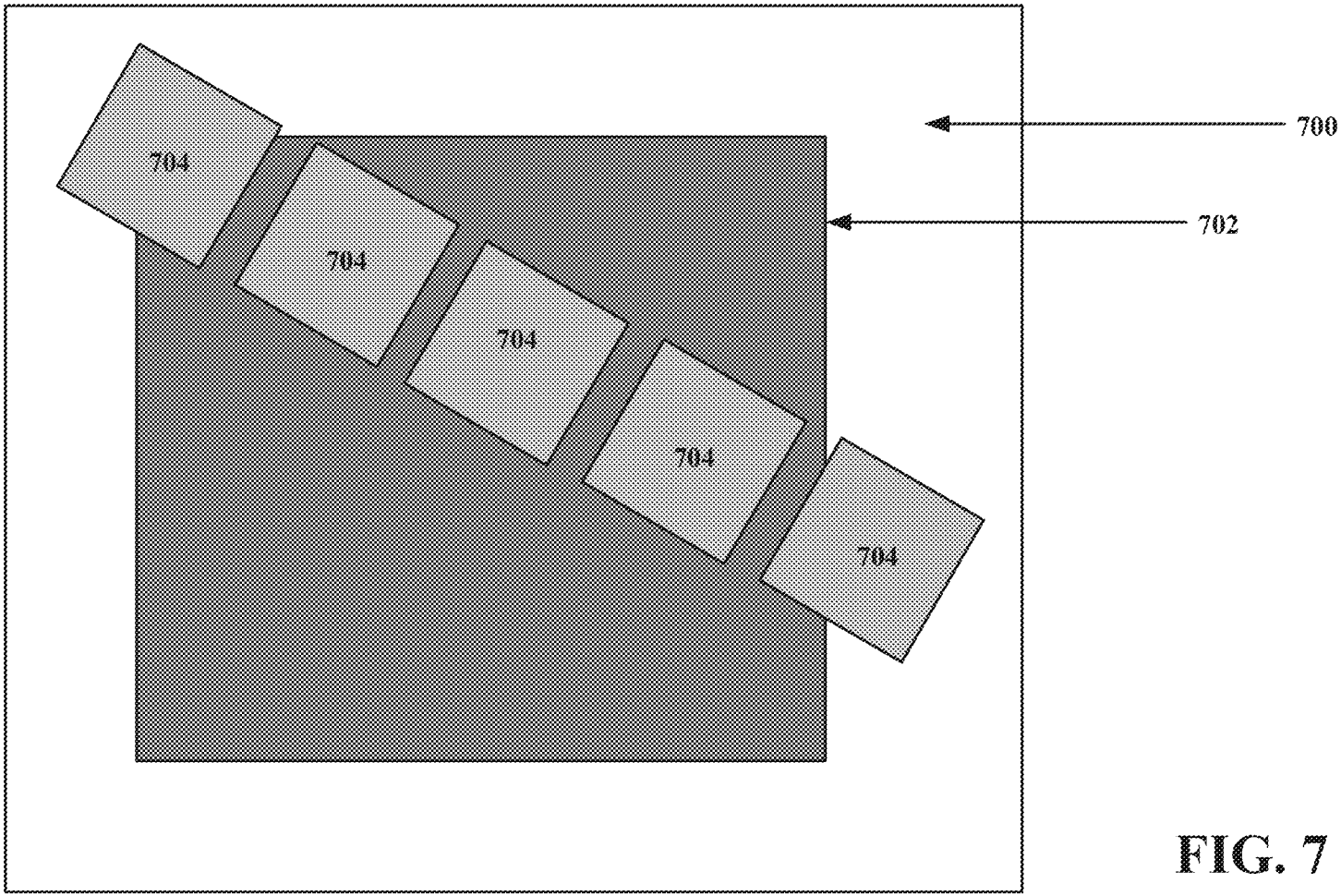
FIG. 7 is a diagram illustrating a scene containing layers of clipping rectangles, according to some embodiments.

FIG. 7 is a diagram of an example scene requiring clipping. In this example, a clipping parent 702 is shown with 5 clipping children 704. All are containers of other widgets which means that children of the clipping parent 702 should be able to render anywhere in the clipping parent 702 (but not outside of it), and children of each child box 704 should only be able to render inside the intersection of the child box 704 with the parent box 702. While no other transformation is shown for the sake of simplicity in the example, it will be appreciated that any transformation could have been applied to the group of widgets as a whole.

Figures 8A, 8B:
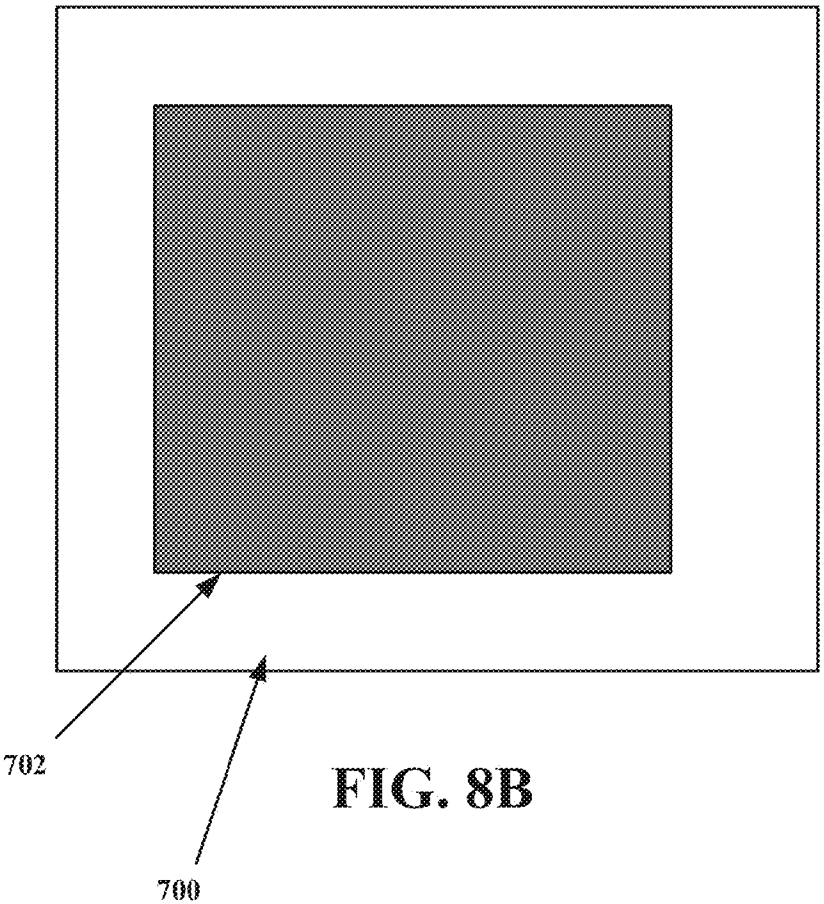
FIGS. 8A-B are a table of layer values corresponding to a scene involving a clipping rectangle, according to some embodiments.

Initially, no clipping is required so all layers have no value. When the first clipping rectangle 702 is encountered in FIG. 8B, a current value of 001 is drawn to the first 3 bits (the mask of layer 1) of the stencil buffer, as shown by the shaded cells of the table in FIG. 8A. Any calls from that point will require that the first 3 bits of the stencil buffer have the value 001 (i.e., reference and draw test mask).

Figures 9A, 9B:
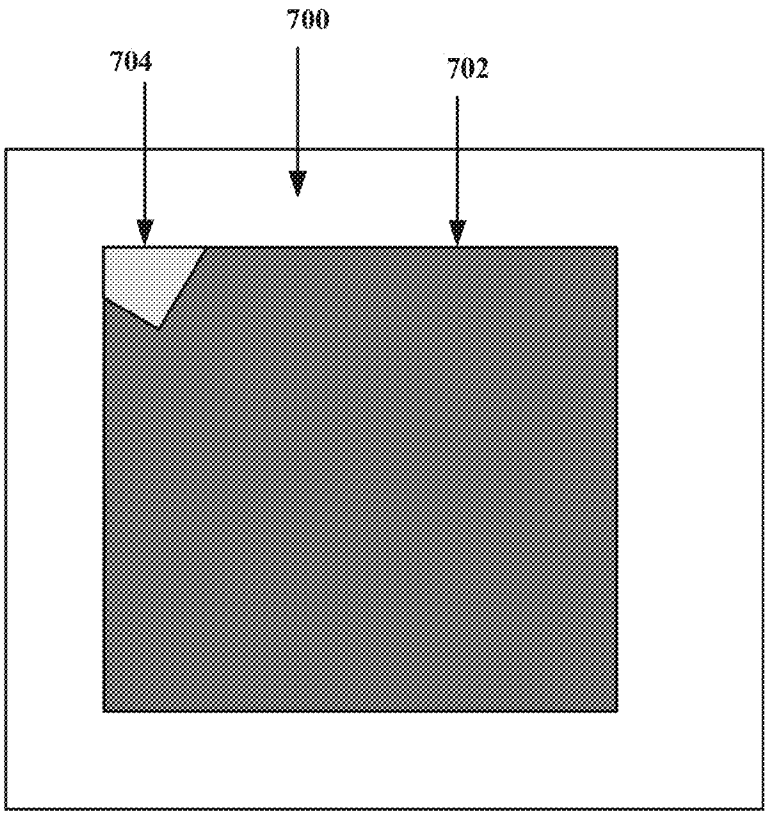
FIG. 9A-B are a table of layer values corresponding to a scene involving clipping rectangles, according to some embodiments.

When the first child box 704 is encountered, as shown in FIG. 9B, the first layer (001 for the first 3 bits) is tested and a current value of 001 is drawn to bits 3 through 5 corresponding to layer 2 (as indicated by the shaded cells of the table illustrated in FIG. 9A). At this point, the parent widget 702 still contains a current value of 00 000 001, and the child widget 704 contains a current value of 00 001 001. The white area 802 has a value of 0. No part of the child widget 704 was drawn in the white area 700 because the white area 700 has a value of 0, and the stencil test mask is set at 00 000 111. With the child widget 704 having a current value of 00 001 001, the stencil test mask is testing for the last 3 bits to be 001. Thus, the child widget 704 is clipped inside of the parent widget 702.

Figures 10A, 10B:
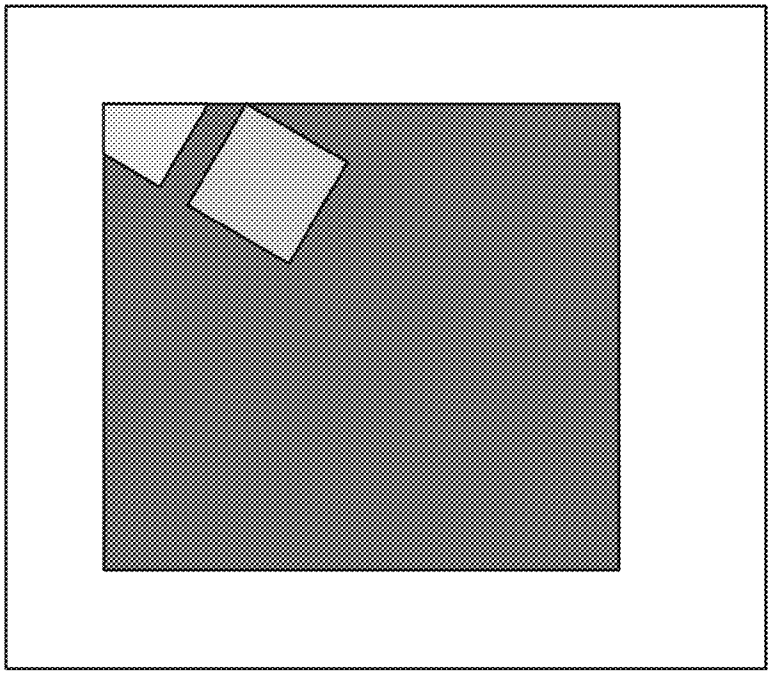
FIG. 10A-B are a table of layer values corresponding to a scene involving clipping rectangles, according to some embodiments.

At the next step, clipping occurs on a sibling child box 704, and accordingly, the current value of layer 2 is incremented, as is reflected by the shaded cells of the table shown in FIG. 10A. This process may continue until all children boxes 704 are clipped and processed. As the clipping proceeds on higher layers, the current values of the lower layers may be reset to 0 because any draw call, whether to the stencil buffer or to the screen will test on a different value for the upper layers.

In some embodiments, a dynamic layer allocation approach may be used. This approach offers the advantages of using the GPU to intersect transformed clipping rectangles, which enables clipping with an arbitrary number of transformations, including rotations and 3D. If rectangles only are not drawn to the stencil buffer, clipping could also be enabled on non-rectangular areas. In some embodiments, a potential problem is the fact that the 8 bits of the stencil buffer are divided between layers and the UI framework does not know beforehand if a clipping tree is going to be more wide or deep and how many siblings will be at each layer. One solution would be to look at what the UI uses across the various screens of the application and find an allocation that works for all screens. Another approach could start with a fixed allocation of layers and based on the previous frame rendered, reallocate layers for a better fit for the next frame.

Another solution would be to create an allocation scheme which solves the problem dynamically (e.g., when the frame is being rendered) and optimally (with no significant penalty), as long as there is an actual solution to the problem (for example, it may be impossible to have 10 levels of clipping with 8 bits). Under this solution, every layer may start with 0 bits allocated to it. Due to the constraints of the 8 bit buffer, there may be at most 8 layers. As the need to allocate new layers or more space for existing layers arises (because of new sibling widgets), then new bits may be allocated, one by one, from the remaining un-allocated bits to each layer.

Figure 11:
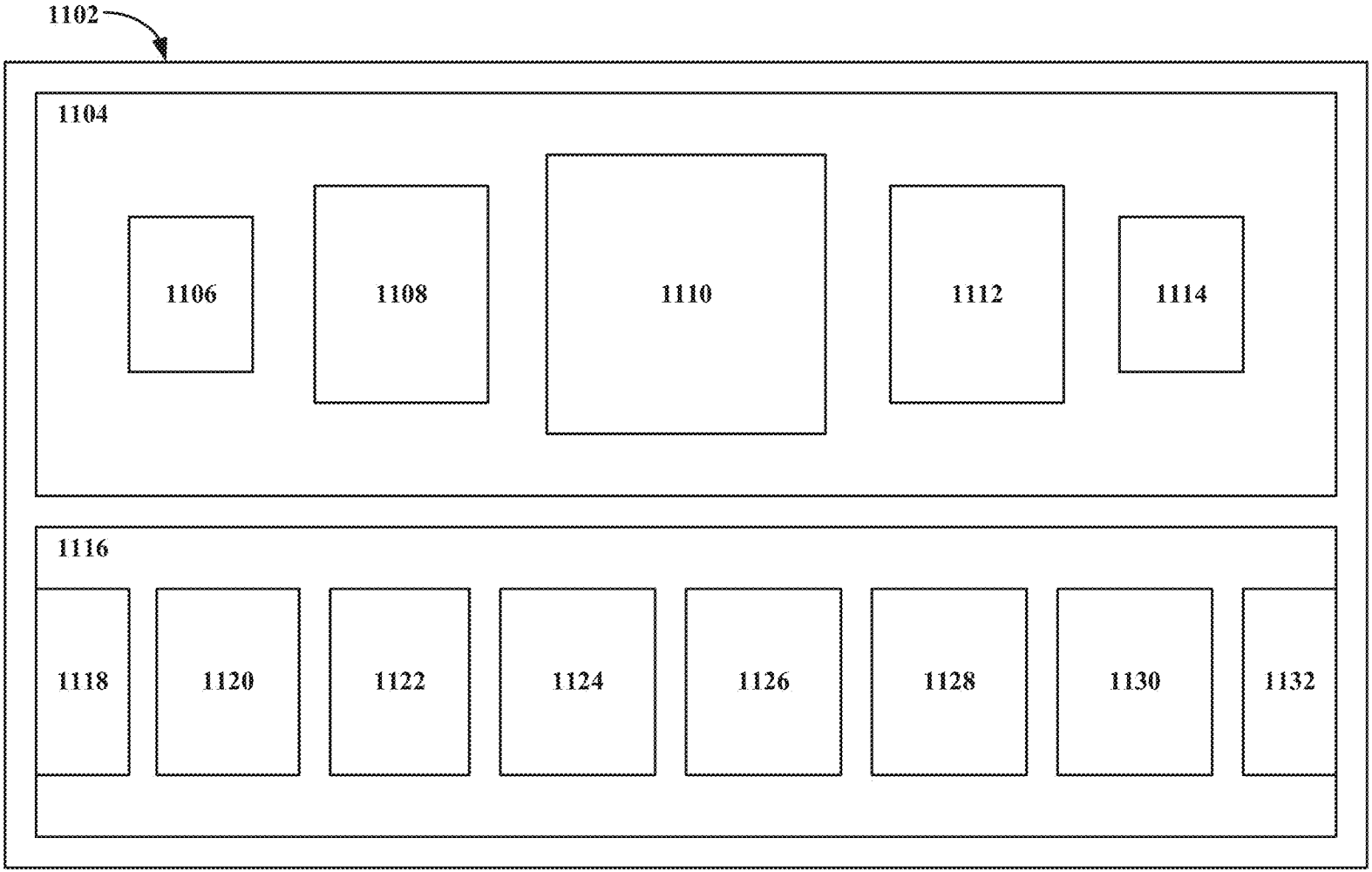
FIG. 11 is a diagram of a scene containing widgets to be rendered, according to some embodiments.

FIG. 11 is an example embodiment of a scene to be rendered. In FIG. 11, widget 1102 is the parent of child widgets 1104 and 1116. Child widget 1104 is the parent of sibling widgets 1106, 1108, 1110, 1112, and 1114. Child widget 1116 is the parent of sibling widgets 1118, 1120, 1122, 1124, 1126, 1128, 1130, and 1132. The widgets may be numbered using reference numbers in rendering order (i.e., as the rendering algorithm would traverse them in a UI tree). All widgets shown are clipping widgets and only clipping widgets are represented in FIG. 11 for simplicity.

The dynamic layer allocation may starting with all bits un-allocated, as shown in FIG. 12A. As parent widget 1102 is clipped, a new value is needed for the first layer, which is unavailable because layer 1 has not bits allocated to it yet. Therefore, a bit is allocated to layer 1, as shown in FIG. 12B. As child widget 1104 is rendered, a new value is needed for the second layer, so a new bit of the 8 bits is allocated for the second layer, as shown in FIG. 12C. As grandchild widget 1106 is rendered, a new value is needed for the third layer, so a new bit is allocated for the third layer, as shown in FIG. 12D. As grandchild widget 1108 is rendered, a new value is needed for the third layer, which at this point can only hold 1 value (due to only 1 bit being allocated to the third layer), so a new bit is allocated to the third layer, and the current value of the third layer becomes 2 (e.g., 0x10), as shown in FIG. 12E. As grandchild widget 1110 is rendered, a new value is needed for the third layer, and its current value becomes 3 (e.g., 0x11) which still fits on its 2 allocated bits (bits 3 and 2). As grandchild widget 1112 is rendered, a new value is needed for the third layer, requiring that a new bit is allocated to the third layer. The third layer thus has a value of 4 (e.g., 0x100), as shown in FIG. 12F. As grandchild widget 1114 is rendered, a new value is needed for the third layer to account for another grandchild widget to be clipped, so the current value of the third layer becomes 5 (e.g., 0x101).

As rendering returns to the child layer with child widget 1116, the dynamic layer allocation algorithm returns to the first level of the clipping tree so the third layer is reset to a value of 0. A new value is needed for the second layer, so a new bit is allocated to the second layer. The second layer thus has a value of 2 (e.g. 0x10) spread between bits 5 and 1, as shown in FIG. 12G. As grandchild widget 1118 is rendered, the dynamic layer allocation algorithm returns to the third layer, having a current value of 0. Thus, a new value is needed for the third layer, and accordingly, a new bit is allocated to the third layer, giving it a value of 1 (0x001). Grandchildren widgets 1120, 1122, 1124, 1126, 1128, and 1130 are rendered in a similar manner with increasing values for the third layer (e.g., 0x010, 0x011, 0x100, 0x101, 0x110, 0x111). As the last grandchild widget 1132 is rendered, a new value is needed for the third layer, which requires a new bit. The value for the third layer then becomes 8 (e.g., 0x1000 spread between bits 6, 4, 3, and 2), as shown in FIG. 12H.

FIG. 13 summarizes the values for each layer in a table. As can be seen, the first layer may have a value of 1, represented by 1 bit (bit 0), which is therefore 1. The first layer may correspond to the parent widget 1102. The second layer may have a value of 2 (e.g., binary value 0x10), represented by 2 bits (bits 1 and 5). The second layer may correspond to the child widgets 1104 and 1116. The third layer may have a value of 8 (e.g., binary value 0x1000), represented by 4 bits (bits 2, 3, 4, and 6). The third layer may correspond to grandchildren widgets 1118, 1120, 1122, 1124, 1126, 1128, 1130, and 1132. The previous value of the third layer corresponding to grandchildren widgets 1106, 1108, 1110, 1112, and 1114 was reset to 0 when the dynamic layer allocation algorithm returned from the third layer to the second layer when rendering child widget 1116.

The reference value may be the logical OR of the current value of all layers. It contains both the value to write to the stencil buffer (the current layer's value, i.e., layer 3) as well as the test value for the lower layers (i.e., layers 1 and 2). The write mask corresponds to the bits allocated to the current layer. The write mask prevents writing to other layers (however, by testing for the value in the stencil buffer to match the one from the previous layers, the write mask cannot be used because it would simply replace the previous value with the same one on the bits corresponding to the previous layers). The stencil test mask may be the mask used when drawing the clipping area to the stencil buffer. The stencil test mask is a combination of previous layers. By using the stencil test mask, only the bits of the current layer are modified when inside the clipping areas of the previous layers. The draw test mask is the mask to be used for any subsequent draw calls and for testing all layers (e.g., layers 1, 2, and 3). Both the stencil test mask and the draw test mask are masks which are applied to the reference value and the current value of the stencil buffer before a pixel is drawn.

The number of clipping rectangles capable of being supported by the dynamic layer allocation algorithm and the 8 bit stencil buffer may depend on the structure of the scene. If the clipping rectangles were siblings, there would only be one layer, meaning that up to 255 clipping rectangles could be accommodated. If the clipping rectangles were all children of each other, then eight layers could be supported and 8 clipping rectangles.

Each layer that is created with n bits can only hold $2^{n-1}$ values (and not $2^n$ because the value 0 is reserved for "not in the clipping area"). So a 2 bit layer can only support 3 values, a 3 bit layer can support 7 values, a 4 bit layer can support 15 values, a 5 bit layer can support 31 values, and so forth. Bits cannot be re-allocated between layers when going back up the UI clipping tree because there would be dirty values in the stencil buffer coming from other layers. For an unbalanced UI tree (for example, 3 layers, but in one branch a fairly large second layer and in another branch a fairly large third layer), the dynamic layer allocation algorithm may still be able to render the scene but may not do so as efficiently as possible. For example, in the scene shown in FIG. 14, child widget 1104 from FIG. 11 has been removed but the remaining widgets are identical to the embodiment of FIG. 11. In allocating layers to the clipping rectangles, a first layer may have 1 widget—parent widget 1102—and thus only 1 bit needed. A second layer may have 6 widgets now—child widgets 1106,

1108, 1110, 1112, 1114, and 1116, and thus requires 3 bits (e.g., 0x110) to support the clipping rectangles. The third layer has 8 widgets—grandchildren widgets 1118, 1120, 1122, 1124, 1126, 1128, 1130, and 1132, and thus requires 4 bits to support the clipping rectangles.

Figure 14:
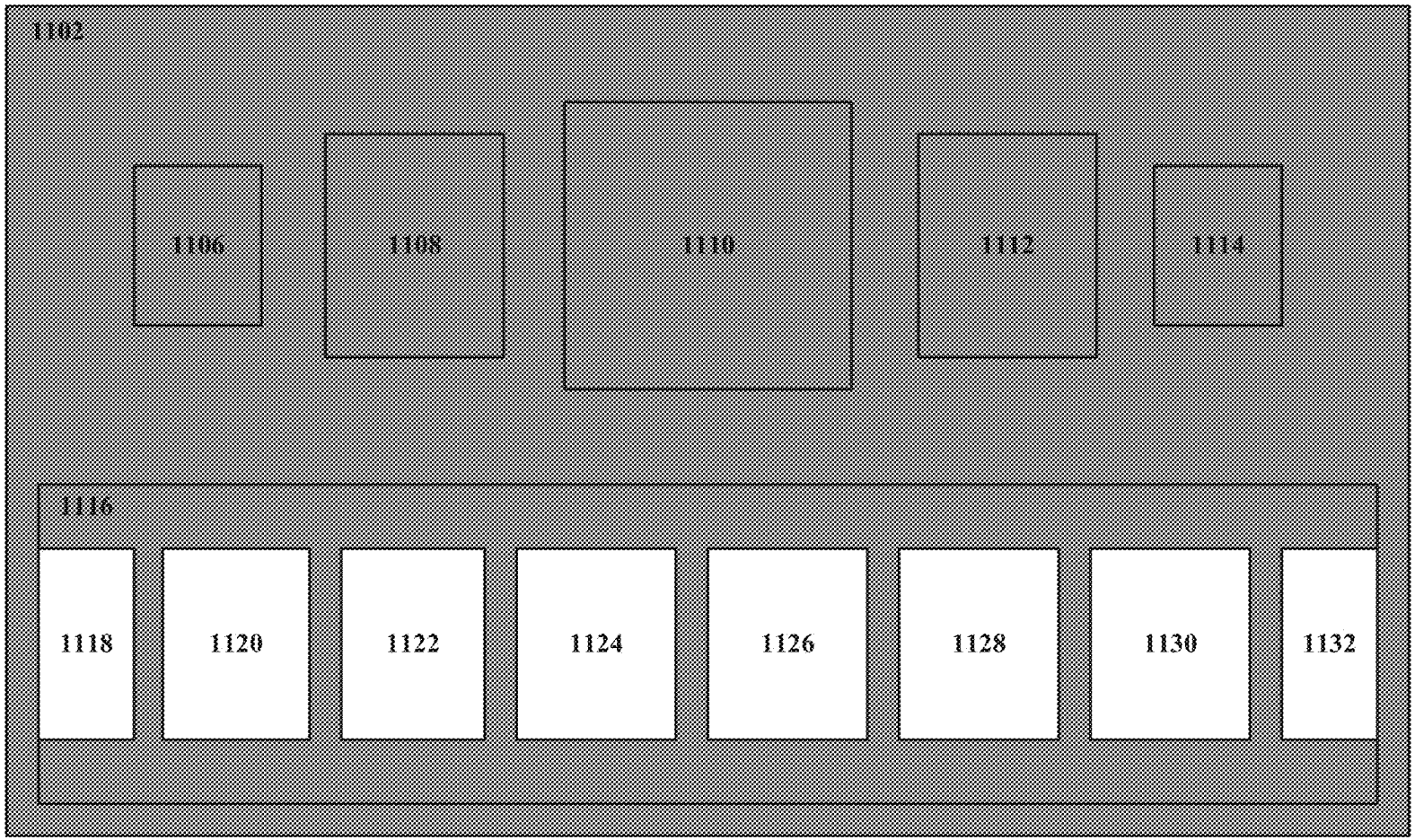
FIG. 14 is a diagram of a scene containing widgets to be rendered, according to some embodiments.

The scene of FIG. 14 would still render fine, but all 8 bits of the stencil buffer would be required. The second layer could accommodate one additional clipping widget, and the third layer could accommodate seven additional clipping widgets, but the first layer could not accommodate any additional clipping widgets, nor could there by a fourth layer. The scene shown in FIG. 14 uses less clipping rectangles than the previous scene shown in FIG. 11, but requires more bits to be rendered.

Figure 15:
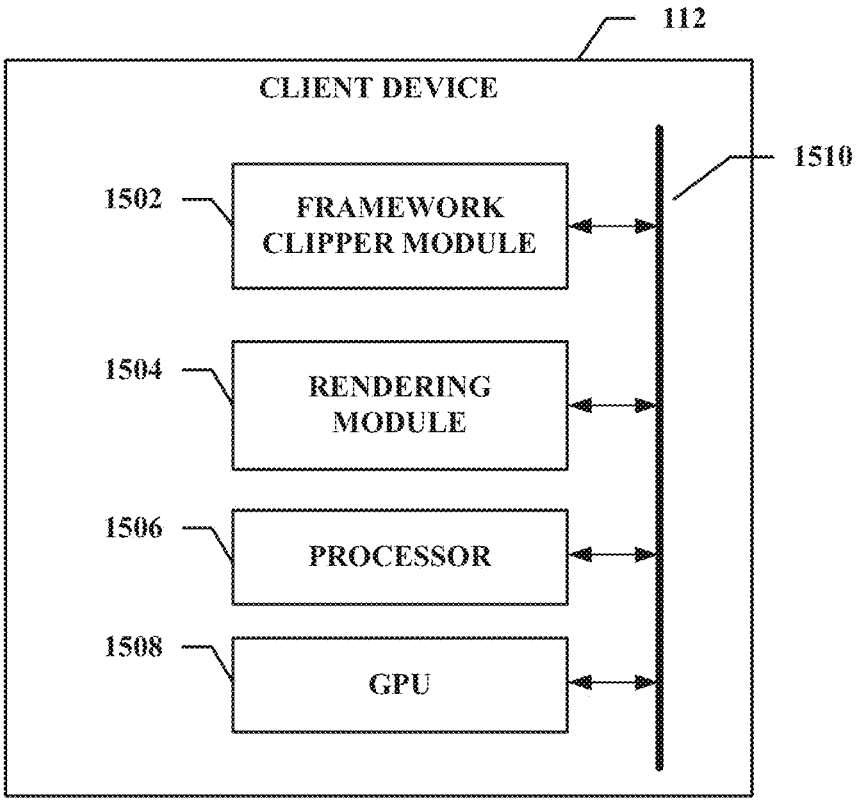
FIG. 15 is a block diagram of example modules and components of a client device that implements a dynamic layer allocation algorithm for framework clipping, according to some embodiments.

FIG. 15 is a diagram illustrating a modules and components of a client device. the client device may include a processor, such as CPU 1506, and a separate GPU 1508. In some embodiments, one or both of the CPU 1506 and GPU 1508 may be responsible for rendering application user interfaces and other scenes. In some embodiments, the CPU 1506 and/or GPU 1508 may use a rendering module 1504 to render or aid in the rendering of a user interface or other scene. In some embodiments, the CPU 1506 and/or the GPU 1508 may also use a framework clipper module 1502 to aid in implementing the embodiments disclosed here, such as the dynamic layer allocation algorithm, for use in clipping and rendering widgets. For example, in some embodiments, the framework clipper module 1502 may dynamically allocate the bits of the stencil buffer to the various layers of clipping widgets. The CPU 1506 and/or the GPU 1508 may use the dynamically allocated layers to then render the scene. The CPU 1506, GPU 1508, framework clipper module 1502, and rendering module 1504 may communicate with each other using a bi-directional bus 1510. In some embodiments, the framework clipper module 1502 and/or rendering module 1504 may be part of the CPU 1506 or GPU 1508.

Figure 16:
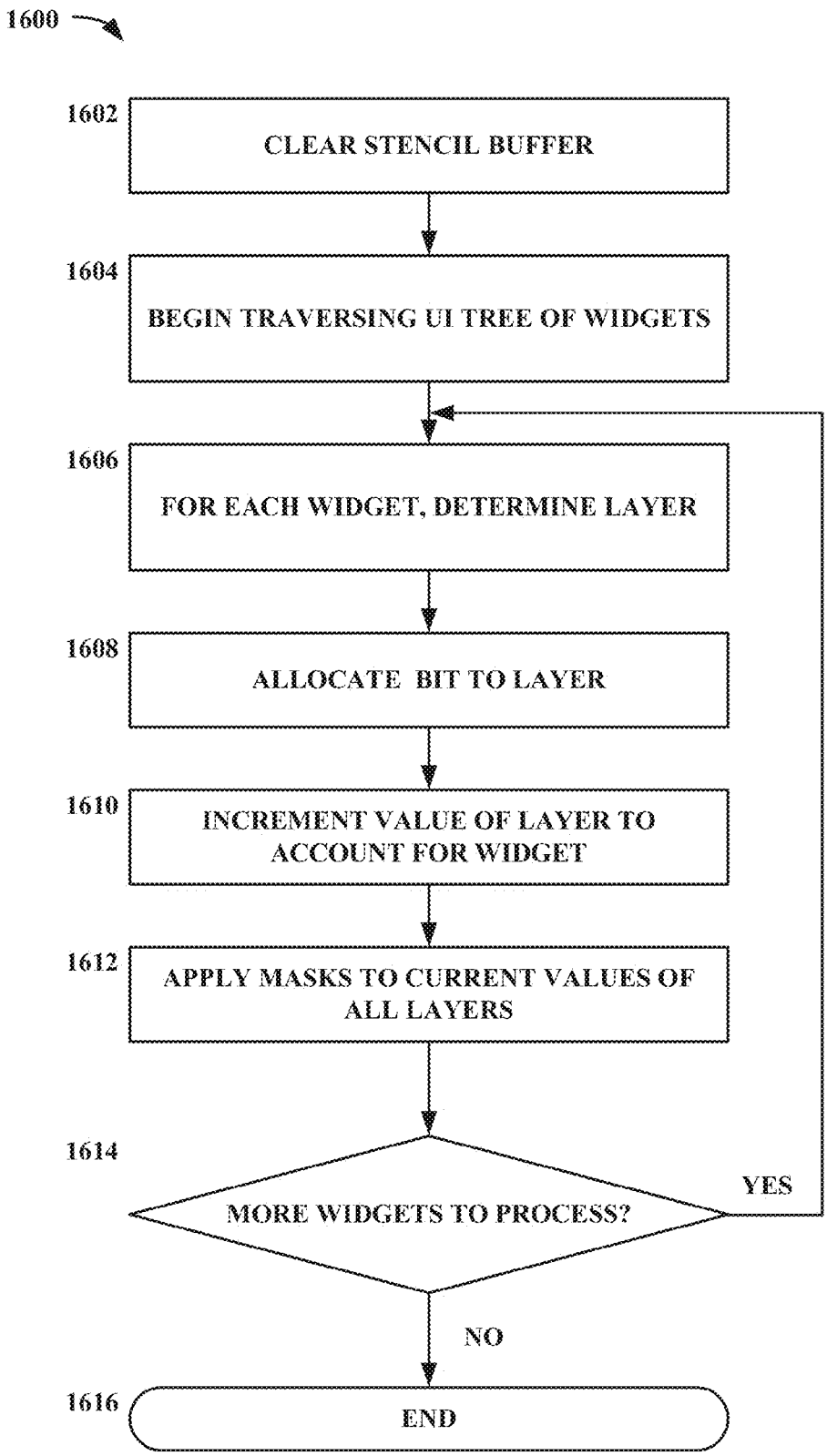
FIG. 16 is a flow diagram of an example method for implementing a dynamic layer allocation algorithm for supporting framework clipping, according to some embodiments.

FIG. 16 is a flow diagram of an example method 1600 for dynamically allocating layers to widgets that require clipping. At block 1602, a stencil buffer is cleared. At block 1604, the dynamic layer allocation algorithm may begin traversing a user interface tree of widgets. In some embodiments, the framework clipper module 1502 of FIG. 15 may implement the dynamic layer allocation algorithm, while in other embodiments, the CPU 1506 and/or GPU 1508 may implement the dynamic layer allocation algorithm. At block 1606, a widget may be encountered. The position of the widget on the UI tree may inform the dynamic layer allocation algorithm of the relationship of the widget to other widgets (if applicable) and the layer which the widget should be assigned. For a first widget, it is assumed that the widget is a root or parent widget that belongs to a first layer. As the UI tree is traversed, child widgets of a parent widget may occupy a higher layer, and grandchildren widgets may occupy yet a higher layer. Sibling widgets may occupy the same layer. At block 1608, a bit may be allocated for a layer representing the widget. Each layer having one or more bits allocated to it may support $2^{n-1}$ widgets within the layer. At block 1610, a current value of the layer may be incremented by one to reflect that a widget is being added to the layer for clipping.

At block 1614 one or more masks may be applied to the current values of the allocated layers. A reference value may be generated by performing a logical-OR operation of the values of the all layers. A write mask corresponds to bits allocated to the current layer. For example, if bits 6, 4, 3, and 2 have been allocated to layer 3, the write mask may have a value of 01011100. The write mask may prevent the writing of values to other layers. A stencil test mask may be used when drawing the clipping area to the stencil buffer. The stencil test mask may be a logical-OR of the layers lower than the current layer. For example, if the current layer is layer 3, the stencil test mask may have a value corresponding to the values of the layer 2 and layer 1. The stencil mask may be applied to permit modification of only the bits of the current layer. A draw test mask is a mask used for any subsequent draw calls. The draw test mask tests for all layers. In some embodiments, both the stencil test mask and the draw test mask are masks that are applied to the reference value and the current value of the stencil buffer before a pixel is drawn.

At decision block 1612, it is determined if there are more widgets to process. If so, the example method returns to block 1606, where the appropriate layer for the next widget is determined. If the next widget is of a lower layer than the previous widget (e.g., previous widget was grandchild widget and next widget is a child widget), the upper layer may be reset to 0 to reflect that the previous grandchildren widgets may not be related to the next child widget. The example method may continue until all widgets have been processed and/or all bits of the stencil buffer (e.g., 8 bits) have been allocated to layers. It is possible during the allocation process that the bits allocated to the layers may not be contiguous, that is, if the stencil buffer has 8 bits (e.g., bits 7 to 0), it is possible a layer may have allocated to it non-contiguous bits. If all widgets have been accounted for, the example method ends at terminator block 1616.

Although not included in the example method of FIG. 16, the stencil buffer may be used to specify a pattern so that widgets or portions of widgets that pass the stencil test are rendered to the color buffer and ultimately written to a pixel.

Modules, Components and Logic

Certain embodiments are described herein as including logic or a number of components, modules, or mechanisms. A component or module is a non-transitory and tangible unit capable of performing certain operations and may be configured or arranged in a certain manner. In example embodiments, one or more computer systems (e.g., a standalone, client or server computer system) or one or more components of a computer system (e.g., a processor or a group of processors) may be configured by software (e.g., an application or application portion) as a component that operates to perform certain operations as described herein.

In various embodiments, a component or a module may be implemented mechanically or electronically. For example, a component or a module may comprise dedicated circuitry or logic that is permanently configured (e.g., as a special-purpose processor) to perform certain operations. A component or a module also may comprise programmable logic or circuitry (e.g., as encompassed within a general-purpose processor or other programmable processor) that is temporarily configured by software to perform certain operations. It will be appreciated that the decision to implement a component mechanically, in dedicated and permanently configured circuitry, or in temporarily configured circuitry (e.g., configured by software) may be driven by cost and time considerations.

Accordingly, the term "component" or "module" should be understood to encompass a tangible entity, be that an entity that is physically constructed, permanently configured (e.g., hardwired) or temporarily configured (e.g., programmed) to operate in a certain manner and/or to perform certain operations described herein. Considering embodiments in which components or modules are temporarily configured (e.g., programmed), each of the components or modules need not be configured or instantiated at any one instance in time. For example, where the components or modules comprise a general-purpose processor configured using software, the general-purpose processor may be configured as respective different components at different times. Software may accordingly configure a processor, for example, to constitute a particular component or module at one instance of time and to constitute a different component or module at a different instance of time.

Components or modules can provide information to, and receive information from, other components or modules. Accordingly, the described components may be regarded as being communicatively coupled. Where multiple of such components or modules exist contemporaneously, communications may be achieved through signal transmission (e.g., over appropriate circuits and buses) that connect the components or modules. In embodiments in which multiple components or modules are configured or instantiated at different times, communications between such components or modules may be achieved, for example, through the storage and retrieval of information in memory structures to which the multiple components or modules have access. For example, one component or module may perform an operation, and store the output of that operation in a memory device to which it is communicatively coupled. A further component or module may then, at a later time, access the memory device to retrieve and process the stored output. Components or modules may also initiate communications with input or output devices, and can operate on a resource (e.g., a collection of information).

Electronic Apparatus and System

Example embodiments may be implemented in digital electronic circuitry, or in computer hardware, firmware, software, or in combinations of them. Example embodiments may be implemented using a computer program product, e.g., a computer program tangibly embodied in an information carrier, e.g., in a machine-readable medium for execution by, or to control the operation of, data processing apparatus, e.g., a programmable processor, a computer, or multiple computers.

A computer program can be written in any form of programming language, including compiled or interpreted languages, and it can be deployed in any form, including as a stand-alone program or as a module, subroutine, or other unit suitable for use in a computing environment. A computer program can be deployed to be executed on one computer or on multiple computers at one site or distributed across multiple sites and interconnected by a communication network.

In example embodiments, operations may be performed by one or more programmable processors executing a computer program to perform functions by operating on input data and generating output. Method operations can also be performed by, and apparatus of example embodiments may be implemented as, special purpose logic circuitry, e.g., an FPGA (field programmable gate array) or an ASIC (application-specific integrated circuit).

The computing system can include clients and servers. A client and server are generally remote from each other and typically interact through a communication network. The relationship of client and server arises by virtue of computer programs running on the respective computers and having a client-server relationship to each other. In embodiments deploying a programmable computing system, it will be appreciated that that both hardware and software architectures require consideration. Specifically, it will be appreciated that the choice of whether to implement certain functionality in permanently configured hardware (e.g., an ASIC), in temporarily configured hardware (e.g., a combination of software and a programmable processor), or a combination permanently and temporarily configured hardware may be a design choice. Below are set out hardware (e.g., machine) and software architectures that may be deployed, in various example embodiments.

Example Machine Architecture and Machine-Readable Medium

Figure 17:
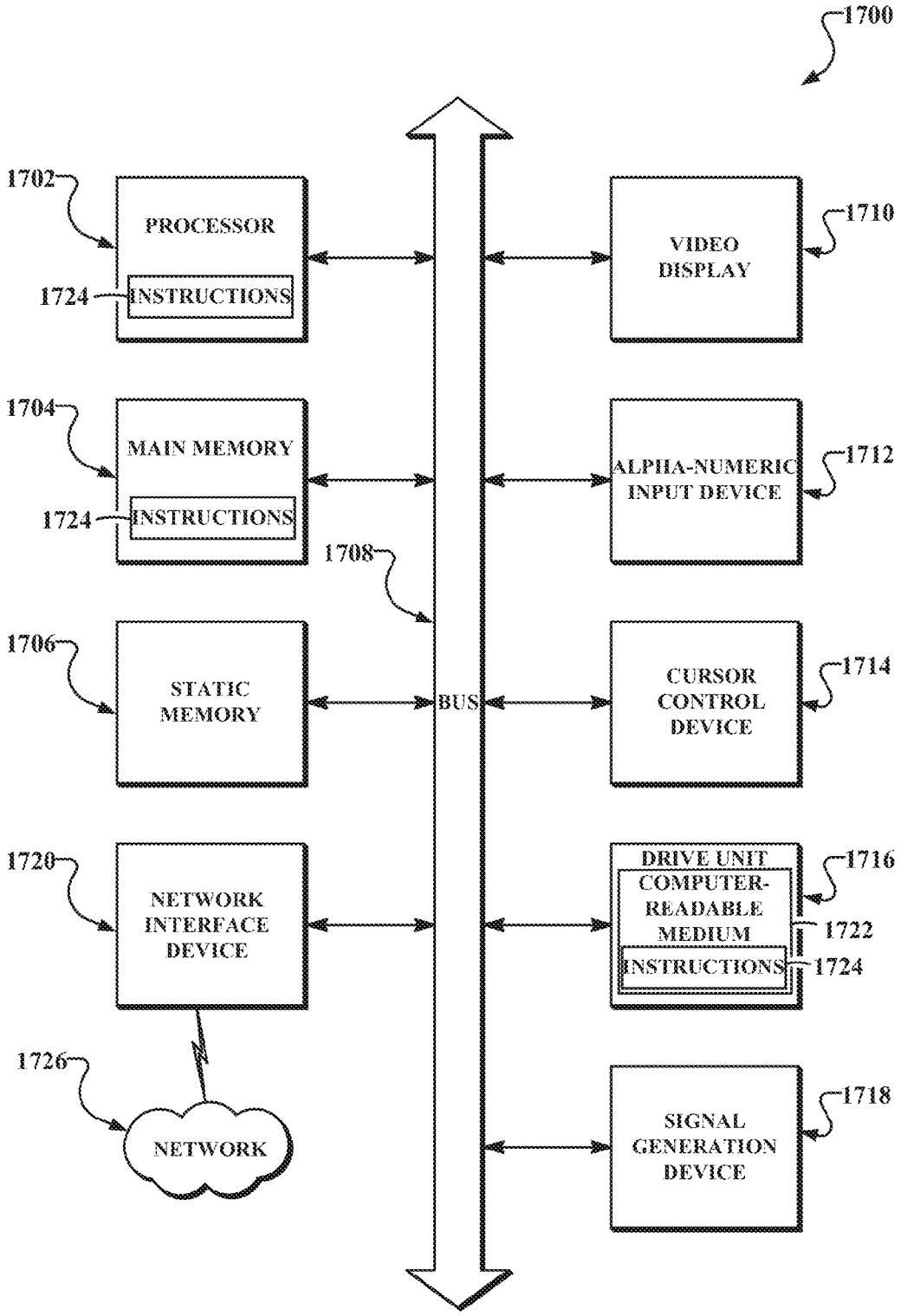
FIG. 17 shows a diagrammatic representation of a machine in the example form of a computer system.

FIG. 17 is a block diagram of machine in the example form of a computer system 1700 within which instructions, for causing the machine to perform any one or more of the methodologies discussed herein, may be executed. In alternative embodiments, the machine operates as a standalone device or may be connected (e.g., networked) to other machines. In a networked deployment, the machine may operate in the capacity of a server or a client machine in server-client network environment. The machine may be a personal computer (PC), a tablet PC, a set-top box (STB), a Personal Digital Assistant (PDA), a cellular telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computer system 1700 includes at least one processor 1702 (e.g., a central processing unit (CPU), a graphics processing unit (GPU) or both), a main memory 1704 and a static memory 1706, which communicate with each other via a bus 1708. The computer system 1700 may further include a video display unit 1710 (e.g., a liquid crystal display (LCD) or a cathode ray tube (CRT)). The computer system 1700 also includes an alphanumeric input device 1712 (e.g., a keyboard), a user interface (UI) navigation device 1714 (e.g., a mouse), a disk drive unit 1716, a signal generation device 1718 (e.g., a speaker) and a network interface device 1720.

Machine-Readable Medium

The disk drive unit 1716 includes a machine-readable medium 1722 on which is stored one or more sets of instructions and data structures (e.g., software 1724) embodying or utilized by any one or more of the methodologies or functions described herein. The software 1724 may also reside, completely or at least partially, within the main memory 1704 and/or within the processor 1702 during execution thereof by the computer system 1700, the main memory 1704 and the processor 1702 also constituting machine-readable media.

While the machine-readable medium 1722 is shown in an example embodiment to be a single medium, the term "machine-readable medium" may include a single medium or multiple media (e.g., a centralized or distributed database, and/or associated caches and servers) that store the one or more instructions or data structures. The term "machine-readable medium" shall also be taken to include any non-transitory tangible medium that is capable of storing, encoding or carrying instructions for execution by the machine and that cause the machine to perform any one or more of the methodologies of the present invention, or that is capable of storing, encoding or carrying data structures utilized by or associated with such instructions. The term "machine-readable medium" shall accordingly be taken to include, but not be limited to, solid-state memories, and optical and magnetic media. Specific examples of machine-readable media include non-volatile memory, including by way of example semiconductor memory devices, e.g., EPROM, EEPROM, and flash memory devices; magnetic disks such as internal hard disks and removable disks; magneto-optical disks; and CD-ROM and DVD-ROM disks.

Transmission Medium

The software 1724 may further be transmitted or received over a communications network 1726 using a transmission medium. The software 1724 may be transmitted using the network interface device 1720 and any one of a number of well-known transfer protocols (e.g., HTTP). Examples of communication networks include a local area network ("LAN"), a wide area network ("WAN"), the Internet, mobile telephone networks, Plain Old Telephone (POTS) networks, and wireless data networks (e.g., WiFi and WiMax networks). The term "transmission medium" shall be taken to include any intangible medium that is capable of storing, encoding or carrying instructions for execution by the machine, and includes digital or analog communications signals or other intangible medium to facilitate communication of such software.

Example Three-Tier Software Architecture

In some embodiments, the described methods may be implemented using one a distributed or non-distributed software application designed under a three-tier architecture paradigm. Under this paradigm, various parts of computer code (or software) that instantiate or configure components or modules may be categorized as belonging to one or more of these three tiers. Some embodiments may include a first tier as an interface (e.g., an interface tier). Further, a second tier may be a logic (or application) tier that performs application processing of data inputted through the interface level. The logic tier may communicate the results of such processing to the interface tier, and/or to a backend, or storage tier. The processing performed by the logic tier may relate to certain rules, or processes that govern the software as a whole. A third storage tier may be a persistent storage medium or a non-persistent storage medium. In some cases, one or more of these tiers may be collapsed into another, resulting in a two-tier architecture, or even a one-tier architecture. For example, the interface and logic tiers may be consolidated, or the logic and storage tiers may be consolidated, as in the case of a software application with an embedded database. The three-tier architecture may be implemented using one technology, or, a variety of technologies. The example three-tier architecture, and the technologies through which it is implemented, may be realized on one or more computer systems operating, for example, as a standalone system, or organized in a server-client, distributed or so some other suitable configuration. Further, these three tiers may be distributed between more than one computer systems as various components.

Components

Example embodiments may include the above described tiers, and processes or operations about constituting these tiers may be implemented as components. Common to many of these components is the ability to generate, use, and manipulate data. The components, and the functionality associated with each, may form part of standalone, client, or server computer systems. The various components may be implemented by a computer system on an as-needed basis. These components may include software written in an object-oriented computer language such that a component oriented, or object-oriented programming technique can be implemented using a Visual Component Library (VCL), Component Library for Cross Platform (CLX), Java Beans (JB), Java Enterprise Beans (EJB), Component Object Model (COM), Distributed Component Object Model (DCOM), or other suitable technique.

Software for these components may further enable communicative coupling to other components (e.g., via various Application Programming interfaces (APIs)), and may be compiled into one complete server and/or client software application. Further, these APIs may be able to communicate through various distributed programming protocols as distributed computing components.

Distributed Computing Components and Protocols

Some example embodiments may include remote procedure calls being used to implement one or more of the above described components across a distributed programming environment as distributed computing components. For example, an interface component (e.g., an interface tier) may form part of a first computer system that is remotely located from a second computer system containing a logic component (e.g., a logic tier). These first and second computer systems may be configured in a standalone, server-client, or some other suitable configuration. Software for the components may be written using the above described object-oriented programming techniques, and can be written in the same programming language, or a different programming language. Various protocols may be implemented to enable these various components to communicate regardless of the programming language used to write these components. For example, a component written in C++ may be able to communicate with another component written in the Java programming language through utilizing a distributed computing protocol such as a Common Object Request Broker Architecture (CORBA), a Simple Object Access Protocol (SOAP), or some other suitable protocol. Some embodiments may include the use of one or more of these protocols with the various protocols outlined in the Open Systems Interconnection (OSI) model, or Transmission Control Protocol/Internet Protocol (TCP/IP) protocol stack model for defining the protocols used by a network to transmit data.

A System of Transmission between a Server and Client

Example embodiments may use the OSI model or TCP/IP protocol stack model for defining the protocols used by a network to transmit data. In applying these models, a system of data transmission between a server and client may for example include five layers comprising: an application layer, a transport layer, a network layer, a data link layer, and a physical layer. In the case of software, for instantiating or configuring components, having a three-tier architecture, the various tiers (e.g., the interface, logic, and storage tiers) reside on the application layer of the TCP/IP protocol stack. In an example implementation using the TCP/IP protocol stack model, data from an application residing at the application layer is loaded into the data load field of a TCP segment residing at the transport layer. This TCP segment also contains port information for a recipient software application residing remotely. This TCP segment is loaded into the data load field of an IP datagram residing at the network layer. Next, this IP datagram is loaded into a frame residing at the data link layer. This frame is then encoded at the physical layer, and the data transmitted over a network such as an Internet, Local Area Network (LAN), Wide Area Network (WAN), or some other suitable network. In some cases, Internet refers to a network of networks. These networks may use a variety of protocols for the exchange of data, including the aforementioned TCP/IP, and additionally ATM, SNA, SDI, or some other suitable protocol. These networks may be organized within a variety of topologies (e.g., a star topology), or structures.

Although an embodiment has been described with reference to specific example embodiments, it will be evident that various modifications and changes may be made to these embodiments without departing from the broader spirit and scope of the invention. Accordingly, the specification and drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A method, comprising:

traversing a user interface tree of widgets corresponding to widgets requiring clipping that are present in a scene to be rendered;

for each encountered widget, performing layer allocation operations comprising:

selecting a current, previous, or next layer to which to allocate the widget;

determining whether the selected layer can accommodate the widget;

based on a determination that the selected layer cannot accommodate the widget, allocating a bit from a stencil buffer to the selected layer and incrementing a value of the selected layer to account for the widget being allocated to the selected layer;

based on a determination that the selected layer can accommodate the widget, incrementing the value of the selected layer to account for the widget being allocated to the selected layer;

generating a stencil test mask formed as a combination of the values of layers previous to a current layer;

writing the stencil test mask to a stencil buffer; and repeating the layer allocation operations for each remaining widget, generating, by a processor, a reference layer comprising a logical OR of the current value of all layers;

generating a draw test mask comprising bits of the stencil buffer that are allocated to all layers;

applying the draw test mask to the stencil buffer;

passing contents of the stencil buffer to a frame buffer for drawing a pixel;

generating a write mask that contains bits allocated to the current laver, the write mask preventing writing to other layers; and applying both the stencil test mask and the draw test mask to the reference layer and the current value of the stencil buffer before the pixel is drawn.

2. The method of claim 1, wherein each layer supports $2^{n-1}$ widgets, wherein n is the number of bits allocated to the layer.

3. The method of claim 1, further comprising:

based on a selection of a previous layer to which to allocate the widget, resetting the value of the current layer to zero.

4. The method of claim 1, wherein the stencil buffer has 8 bits.

5. The method of claim 1, wherein the value of the current layer is set as writeable to the stencil buffer and the values of the other layers are set as non-writeable to the stencil buffer.

6. A non-transitory machine-readable storage medium storing a set of instructions that, when executed by at least one processor, causes the at least one processor to perform operations comprising:

traversing a user interface tree of widgets corresponding to widgets requiring clipping that are present in a scene to be rendered;

for each encountered widget, performing layer allocation operations comprising:

selecting a current, previous, or next layer to which to allocate the widget;

determining whether the selected layer can accommodate the widget;

based on a determination that the selected layer cannot accommodate the widget, allocating a bit from a stencil buffer to the selected layer and incrementing a value of the selected layer to account for the widget being allocated to the selected layer;

based on a determination that the selected layer can accommodate the widget, incrementing the value of the selected layer to account for the widget being allocated to the selected layer;

generating a stencil test mask formed as a combination of the values of layers previous to a current layer;

writing the stencil test mask to a stencil buffer; and repeating the layer allocation operations for each remaining widget, generating a reference layer comprising a logical OR of the current value of all layers;

generating a draw test mask comprising bits of the stencil buffer that are allocated to all layers;

applying the draw test mask to the stencil buffer;

passing contents of the stencil buffer to a frame buffer for drawing a pixel;

generating a write mask that contains bits allocated to the current layer, the write mask preventing writing to other layers: and applying both the stencil test mask and the draw test mask to the reference layer and the current value of the stencil buffer before the pixel is drawn.

7. The machine-readable storage medium of claim 6, wherein each layer supports $2^{n-1}$ widgets, wherein n is the number of bits allocated to the layer.

8. The machine-readable storage medium of claim 6, further comprising:

based on a selection of a previous layer to which to allocate the widget, resetting the value of the current layer to zero.

9. The machine-readable storage medium of claim 6, wherein the stencil buffer has 8 bits.

10. The machine-readable storage medium of claim 6, wherein the value of the current layer is set as writeable to the stencil buffer and the values of the other layers are set as non-writeable to the stencil buffer.

11. A system, comprising:

at least one processor;

a framework clipping module implemented by the at least one processor and configured to:

traverse a user interface tree of widgets corresponding to widgets requiring clipping that are present in a scene to be rendered;

for each encountered widget, perform layer allocation operations comprising:

select a current, previous, or next layer to which to allocate the widget;

determine whether the selected layer can accommodate the widget;

based on a determination that the selected layer cannot accommodate the widget, allocate a bit from a stencil buffer to the selected layer and incrementing a value of the selected layer to account for the widget being allocated to the selected layer;

based on a determination that the selected layer can accommodate the widget, increment the value of the selected layer to account for the widget being allocated to the selected layer;

generate a stencil test mask formed as a combination of the values of layers previous to a current layer;

write the stencil test mask to a stencil buffer; and repeat the layer allocation operations for each remaining widget, generate a reference layer comprising a logical OR of the current value of all layers;

generate a draw test mask comprising bits of the stencil buffer that are allocated to all layers;

apply the draw test mask to the stencil buffer;

pass contents of the stencil buffer to a frame buffer for drawing a pixel;

generate a write mask that contains bits allocated to the current layer, the write mask preventing writing to other layers; and apply both the stencil test mask and the draw test mask to the reference layer and the current value of the stencil buffer before the pixel is drawn.

12. The system of claim 11, wherein each layer supports $2^{n-1}$ widgets, wherein n is the number of bits allocated to the layer.

13. The system of claim 11, wherein the framework clipping module is further configured to reset the value of the current layer to zero based on a selection of a previous layer to which to allocate the widget.

14. The system of claim 11, wherein the value of the current layer is set as writeable to the stencil buffer and the values of the other layers are set as non-writeable to the stencil buffer.

* * * * *